US008899975B2

(12) United States Patent
Khan et al.

(10) Patent No.: US 8,899,975 B2
(45) Date of Patent: Dec. 2, 2014

(54) COMBUSTOR HAVING WAKE AIR INJECTION

(75) Inventors: Abdul Rafey Khan, Greenville, SC (US); Bradley Donald Crawley, Simpsonville, SC (US); Rajendra Paniharam, Karnataka (IN); Nishant Govindbhai Parsania, Karnataka (IN)

(73) Assignee: General Electric Company, Schenectady, NY (US)

( * ) Notice: Subject to any disclaimer, the term of this patent is extended or adjusted under 35 U.S.C. 154(b) by 531 days.

(21) Appl. No.: 13/289,567

(22) Filed: Nov. 4, 2011

(65) Prior Publication Data

US 2013/0115566 A1 May 9, 2013

(51) Int. Cl.
*F23R 3/54* (2006.01)
*F23R 3/00* (2006.01)

(52) U.S. Cl.
CPC . *F23R 3/002* (2013.01); *F23R 3/54* (2013.01); *F23R 2900/03044* (2013.01)
USPC ..... 431/352; 431/5; 60/753

(58) Field of Classification Search
CPC ..... F23C 6/00
USPC ..... 431/352, 5; 60/753
See application file for complete search history.

(56) References Cited

U.S. PATENT DOCUMENTS 3,643,426 A 2/1972 Janelid
3,734,639 A 5/1973 Short
4,259,842 A * 4/1981 Koshoffer et al. ..... 60/757
4,786,016 A 11/1988 Presz et al.
4,802,821 A 2/1989 Krietmeier
4,844,689 A 7/1989 Seed
4,896,510 A * 1/1990 Foltz ..... 60/757
5,274,991 A 1/1994 Fitts
5,406,786 A 4/1995 Scharpf et al.
5,486,091 A 1/1996 Sharma
5,813,828 A 9/1998 Norris
6,174,129 B1 1/2001 Mazzola et al.
6,209,325 B1 4/2001 Alkabie
6,345,493 B1 2/2002 Smith et al.
6,402,458 B1 6/2002 Turner
6,409,126 B1 6/2002 Cunningham, Jr.
6,435,814 B1 8/2002 Yu et al.

(Continued)

FOREIGN PATENT DOCUMENTS

DE 102010060286 A1 5/2011
EP 1130321 A1 9/2001

(Continued)

OTHER PUBLICATIONS

Search Report and Written Opinion from EP Application No. 12190915.4 dated Feb. 11, 2013.

(Continued)

*Primary Examiner* — Avinash Savani
(74) *Attorney, Agent, or Firm* — Cantor Colburn LLP

(57) ABSTRACT

A combustor having wake air injection is provided. The combustor includes a fuel nozzle, first and second vessels formed and disposed to define a flow path along which a first fluid flows in first and second opposite directions toward the fuel nozzle, a vane disposed in the flow path and an injector to inject a second fluid into wake formed by an obstruction disposed in the flow path upstream from the vane.

30 Claims, 2 Drawing Sheets

(56) References Cited

U.S. PATENT DOCUMENTS

| | | | | |
|---|---|---|---|---|
| 6,438,961 | B2 | 8/2002 | Tuthill et al. | |
| 6,442,941 | B1 | 9/2002 | Anand et al. | |
| 6,484,505 | B1 | 11/2002 | Brown et al. | |
| 6,527,503 | B2 | 3/2003 | Spano et al. | |
| 6,543,234 | B2 | 4/2003 | Anand et al. | |
| 6,554,562 | B2 | 4/2003 | Dudebout et al. | |
| 6,584,779 | B2 | 7/2003 | Priestley | |
| 6,598,398 | B2 | 7/2003 | Viteri et al. | |
| 6,602,458 | B1 | 8/2003 | Skov | |
| 6,626,635 | B1 | 9/2003 | Prowse et al. | |
| 6,824,710 | B2 | 11/2004 | Viteri et al. | |
| 6,899,081 | B2 | 5/2005 | Bielicki et al. | |
| 6,910,335 | B2 | 6/2005 | Viteri et al. | |
| 6,935,116 | B2 | 8/2005 | Stuttaford et al. | |
| 6,958,383 | B2 | 10/2005 | Desmazeau et al. | |
| D511,377 | S | 11/2005 | Erwan et al. | |
| 7,007,478 | B2 | 3/2006 | Dinu | |
| 7,089,742 | B2 * | 8/2006 | Spooner et al. | 60/753 |
| 7,340,129 | B2 | 3/2008 | Yalin et al. | |
| 7,410,343 | B2 | 8/2008 | Wakazono et al. | |
| 7,412,129 | B2 | 8/2008 | Yalin et al. | |
| 7,420,662 | B2 | 9/2008 | Yalin et al. | |
| 7,654,320 | B2 | 2/2010 | Payton | |
| 7,762,074 | B2 | 7/2010 | Bland et al. | |
| 7,896,645 | B2 * | 3/2011 | Loving | 431/5 |
| 8,234,872 | B2 | 8/2012 | Berry et al. | |
| 8,307,657 | B2 * | 11/2012 | Chila | 60/757 |
| 8,707,672 | B2 | 4/2014 | Zuo et al. | |
| 2002/0124572 | A1 | 9/2002 | Pidcock et al. | |
| 2005/0172607 | A1 | 8/2005 | Ishizaka et al. | |
| 2005/0206196 | A1 | 9/2005 | Ortega et al. | |
| 2006/0101801 | A1 | 5/2006 | Bland | |
| 2006/0283189 | A1 | 12/2006 | Lipinski et al. | |
| 2009/0155062 | A1 | 6/2009 | Guimbard et al. | |
| 2009/0223228 | A1 | 9/2009 | Romoser | |
| 2009/0320484 | A1 | 12/2009 | Lacy et al. | |
| 2010/0054929 | A1 | 3/2010 | Ning et al. | |
| 2010/0326082 | A1 | 12/2010 | Ziminsky et al. | |
| 2011/0107766 | A1 | 5/2011 | Davis, Jr. et al. | |
| 2011/0197586 | A1 | 8/2011 | Berry et al. | |
| 2012/0085100 | A1 | 4/2012 | Hughes et al. | |
| 2012/0167586 | A1 | 7/2012 | Bailey et al. | |
| 2012/0247118 | A1 | 10/2012 | Antoniono et al. | |
| 2012/0297785 | A1 | 11/2012 | Melton et al. | |
| 2013/0115566 | A1 | 5/2013 | Khan et al. | |

FOREIGN PATENT DOCUMENTS

| | | | |
|---|---|---|---|
| EP | 1482246 | A1 | 12/2004 |
| EP | 2154431 | A2 | 2/2010 |
| JP | 54-114619 | A | 9/1979 |
| JP | 54114619 | A | 9/1979 |

OTHER PUBLICATIONS

Extended European Search Report for EP Application No. 12190923.8-1602, dated Feb. 13, 2013, pp. 1-7.

* cited by examiner

COMBUSTOR HAVING WAKE AIR INJECTION

BACKGROUND OF THE INVENTION

The subject matter disclosed herein relates to a combustor and, more particularly, to a combustor having wake air injection capability.

In gas turbine engines and other types of turbomachines, air flow is directed towards premixers in which fuel and air are mixed prior to being combusted in a combustion zone of a combustor. The fuel may be provided by way of fuel injectors disposed in the air flow whereby the mixing of the fuel and air is achieved at least partly as a result of cross flow velocities of the air flow being maintained at and around the fuel injectors.

It has been observed, however, that wakes can be generated by any streamlined or non-streamlined bodies disposed within the air flow. These wakes can disturb the air flow and lead to decreased cross flow velocities at and around the fuel injectors. The decreased cross flow velocities can negatively affect flame holding capability of the system. In some cases, fuel can be pulled up into recirculation zones in the combustion zone where mixed fuel can thus come in contact with hot surfaces of the combustor causing them to autoignite and initiate flame holding in flow sleeve liner annulus passages.

BRIEF DESCRIPTION OF THE INVENTION

According to one aspect of the invention, a combustor having wake air injection is provided. The combustor includes a fuel nozzle, first and second vessels formed and disposed to define a flow path along which a first fluid flows in first and second opposite directions toward the fuel nozzle, a vane disposed in the flow path and an injector to inject a second fluid into wake formed by an obstruction disposed in the flow path upstream from the vane.

According to another aspect of the invention, a combustor having wake air injection is provided. The combustor includes a fuel nozzle configured to form a mixture of combustible materials to be supplied for combustion operations, first and second vessels formed and disposed about the fuel nozzle to define a flow path along which a first fluid flows in a first axial direction, then a radial direction and then a second axial direction, which is opposite the first axial direction, toward the fuel nozzle, a vane disposed in the flow path and an injector to inject a second fluid into wake formed by an obstruction disposed in the flow path at an axial location upstream from the vane.

According to yet another aspect of the invention, a wake air injection apparatus is provided and includes a first vessel having an end in which a mixture of combustible materials is formed and defining a combustion zone in which the mixture is combusted, a second vessel disposed about the first vessel to define a first space through which a flow of a first fluid is directed toward the end of the first vessel and in which an obstruction is disposed to form a wake in the flow of the first fluid and a third vessel disposed about the second vessel to define a second space to receive a second fluid. The second vessel defines an injector, by which the second fluid is injected from the second space to the first space, and which is positioned downstream from the obstruction relative to the flow of the first fluid and in substantial, circumferential alignment with the wake.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
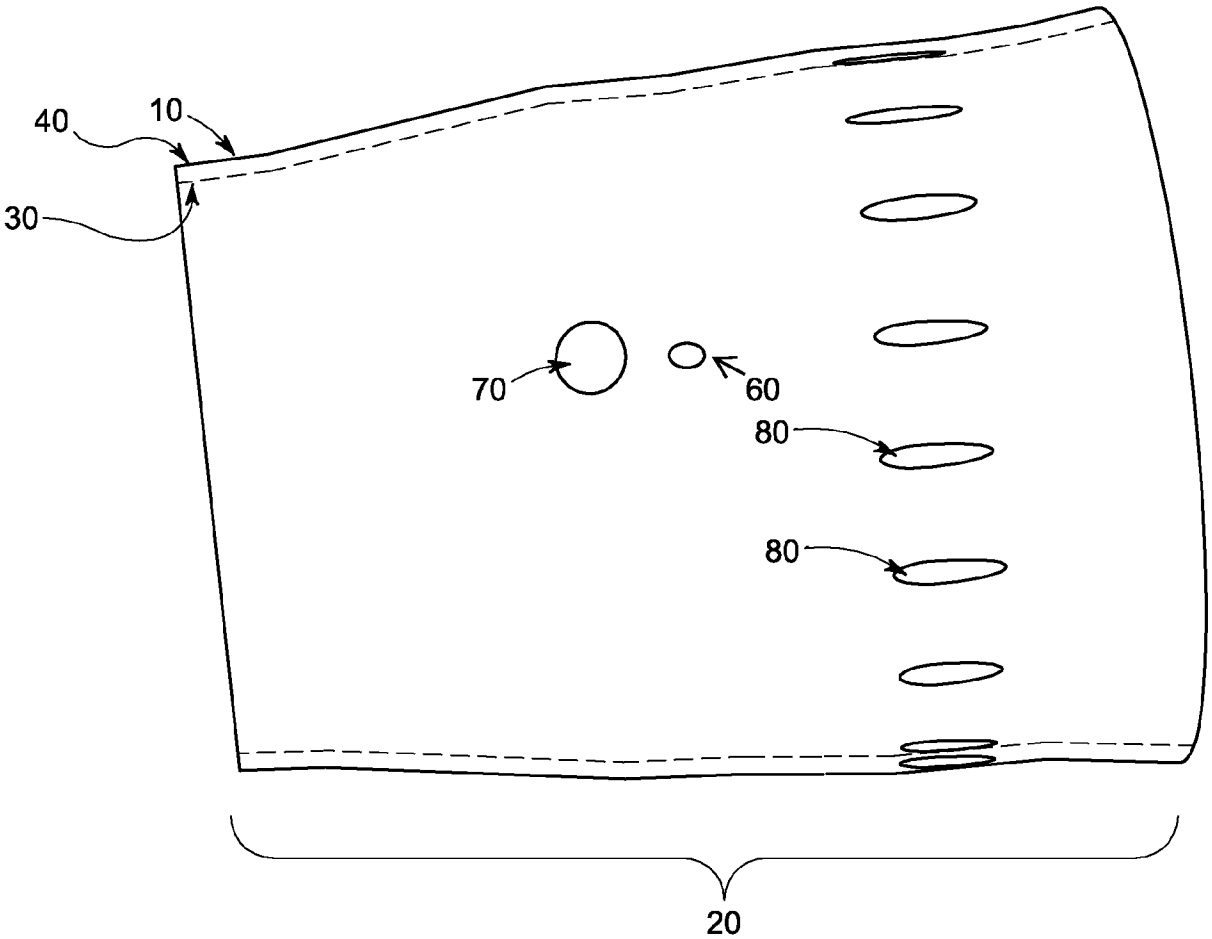
FIG. 1 is a perspective view of a combustor having wake air injection capability.
Figure 2:
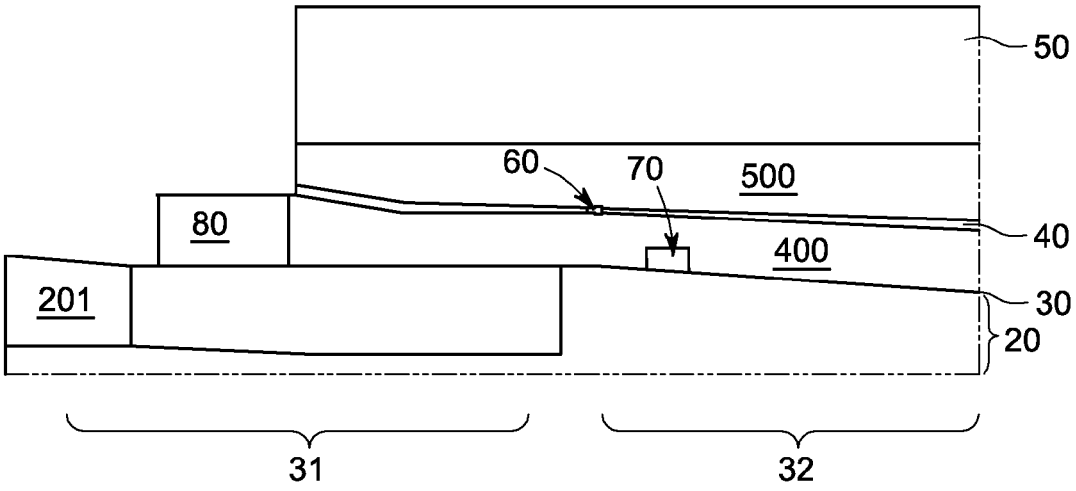
FIG. 2 is an enlarged side view of an interior of the combustor of FIG. 1.

With reference to FIGS. 1 and 2, a wake air injection apparatus ("the apparatus") 10 is provided for use with a combustor 20 of, for example, a gas turbine engine or another type of turbomachine. The apparatus 10 includes a first vessel 30, a second vessel 40, a third vessel 50 and an injector 60. The first vessel 30 may be provided as a liner of the combustor 20 and has an end 31 that may be formed and disposed about a fuel nozzle 201 in which a mixture of combustible materials is formed such that the mixture may be supplied for combustion operations. The first vessel 30 is further formed to define a combustion zone 32 therein in which the mixture of the combustible materials is combusted. The combustion zone 32 is aft of the end 31, which is proximate to a head end of the combustor 20.

The second vessel 40 is disposed about the first vessel 30 and may be provided as a flow sleeve of the combustor 20. The second vessel 40, being disposed about the first vessel 30, may be formed to define a first space 400 in the annulus between the first vessel 30 and the second vessel 40 through which a flow of a first fluid, such as relatively low pressure impingement air, is directed toward the end 31 of the first vessel 30. In particular, the first space 400 forms a flow path along which the first fluid flows in a reverse flow pattern including a first axial direction at a radial location defined radially outwardly of the fuel nozzle 201, an inward radial direction axially forward of the fuel nozzle 201 and a second axial direction, which is opposite the first axial direction, at a radial location defined to be substantially radially aligned with the fuel nozzle 201.

The third vessel 50 may be disposed about the second vessel 40 and may be provided as a compressor discharge casing (CDC). The third vessel 50, being disposed about the second vessel 40, may be formed to define a second space 500 in the annulus between the second vessel 40 and the third vessel 50. A second fluid, such as relatively high pressure CDC air may be supplied to the second space 500.

At least one or more obstructions 70 and at least one or more vanes 80 may be disposed in the first space 400. The at least one or more vanes 80 may be provided, for example, as part of a quaternary fuel injection system and are disposed in a forward section of the first space 400. That is, each vane 80 may serve as a fuel injector by which fuel is injected into the flow of the first fluid. The at least one or more obstructions 70 may or may not be streamlined and are each disposed in the first space 400 at axial locations aft of the at least one or more vanes 80. In accordance with embodiments, as shown in FIG.

2, the obstruction 70 may be substantially, axially aligned with a section of the combustion zone 32, which is proximate to the end 31 of the first vessel 30. Thus, as the first fluid flows along the flow path through the first space 400, the first fluid encounters the at least one or more obstructions 70 prior to encountering the at least one or more vanes 80. As such, each obstruction 70 may form a wake in the flow of the first fluid and, since each obstruction 70 may be substantially circumferentially aligned with a corresponding one or more vanes 80, the wake may encompass the corresponding one or more vanes 80. This can lead to insufficient cross flow velocities at or around the vanes 80 and to decreased flame holding capability.

In order to counteract effects of the wake formed by the obstruction 70, the second vessel 40 is formed to define the injector 60 by which the second fluid is injected from the second space 500 to the first space 400 with an angle of injection of between about 20-80° relative to a centerline of the combustor or the exemplary gas turbine engine in accordance with embodiments. The injector 60 is positioned downstream from the obstruction 70 relative to the flow of the first fluid through the first space 400 or, in other words, at an axial location that is defined axially forward of the obstruction 70. The injector 60 is further positioned in substantial, circumferential alignment with the wake formed by the obstruction 70. Thus, the injection of the second fluid from the second space 500 may serve to reduce disturbances associated with the wake and thereby achieve necessary cross flow velocities at the corresponding one or more vanes 80 for acceptable flame holding margin.

Figure 3:
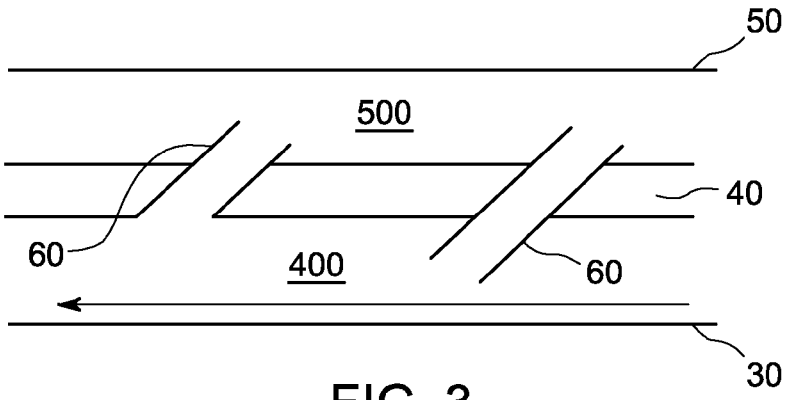
FIG. 3 is a schematic illustration of an injector.
Figure 4:
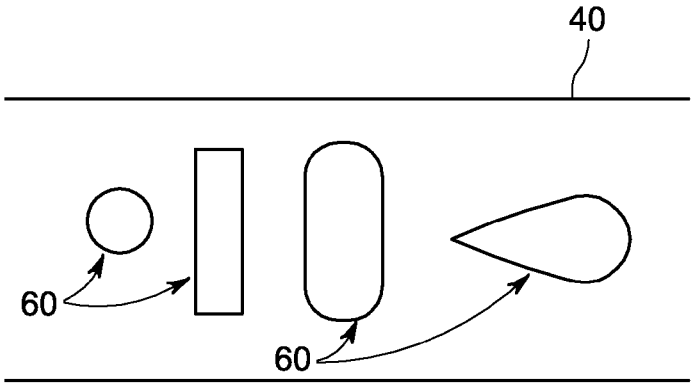
FIG. 4 is a schematic illustration of various shapes of the injector.

With reference to FIGS. 2-4, although the injector 60 is illustrated in FIG. 2 as extending along a radial dimension relative to the combustion zone 32, the injector 60 may alternatively extend along radial and axial dimensions relative to the combustion zone 32, as shown in FIG. 3. Also, as shown in FIG. 4, the injector 60 may have a slot-shaped cross-section, an elliptical or circular cross-section, a race track-shaped cross-section (i.e., a rectangular cross-section with rounded corners or longitudinal ends) or a teardrop-shaped cross-section.

As shown in FIGS. 3 and 4, the injector 60 may be defined as a plurality of injectors 60. One or more of the plural injectors 60 may have a unique shape. Similarly, one or more of the plural injectors 60 may have a unique penetration depth into the first space 400.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A combustor having wake air injection, comprising:

a fuel nozzle;

first and second vessels formed and disposed to define a flow path along which a first, low pressure fluid flows in first and second opposite directions toward the fuel nozzle;

a vane disposed in the flow path; and an injector to inject a second, high pressure fluid into wake formed by an obstruction disposed in the flow path upstream from the vane.

2. The combustor according to claim 1, wherein the injector extends along at least one of radial and axial dimensions.

3. The combustor according to claim 1, wherein the injector has a slot-shaped cross-section.

4. The combustor according to claim 1, wherein the injector has an elliptical cross-section.

5. The combustor according to claim 1, wherein the injector has a race track-shaped cross-section.

6. The combustor according to claim 1, wherein the injector has a teardrop-shaped cross-section.

7. The combustor according to claim 1, wherein the injector comprises plural injectors.

8. The combustor according to claim 7, wherein one or more of the plural injectors has a unique shape and/or a unique penetration depth into the flow path.

9. The combustor according to claim 1, wherein an angle of injection of the second fluid into the wake is between about 20-80°.

10. A combustor having wake air injection, comprising:

a fuel nozzle configured to form a mixture of combustible materials to be supplied for combustion operations;

first and second vessels formed and disposed about the fuel nozzle to define a flow path along which a first, low pressure fluid flows in a first axial direction, then a radial direction and then a second axial direction, which is opposite the first axial direction, toward the fuel nozzle;

a vane disposed in the flow path; and an injector to inject a second fluid, high pressure into wake formed by an obstruction disposed in the flow path at an axial location upstream from the vane.

11. A wake air injection apparatus, comprising:

a first vessel having an end in which a mixture of combustible materials is formed and defining a combustion zone in which the mixture is combusted;

a second vessel disposed about the first vessel to define a first space through which a flow of a first, low pressure fluid is directed toward the end of the first vessel and in which an obstruction is disposed to form a wake in the flow of the first fluid; and a third vessel disposed about the second vessel to define a second space to receive a second, high pressure fluid, the second vessel defining an injector, by which the second fluid is injected from the second space to the first space, and which is positioned downstream from the obstruction relative to the flow of the first fluid and in substantial, circumferential alignment with the wake.

12. The wake air injection apparatus according to claim 11, wherein the obstruction is substantially, axially aligned with a section of the combustion zone proximate to the end of the first vessel and disposed upstream from a fuel injector relative to the flow of the first fluid.

13. The wake air injection apparatus according to claim 11, wherein the injector extends along a radial dimension relative to the combustion zone.

14. The wake air injection apparatus according to claim 11, wherein the injector extends along radial and axial dimensions relative to the combustion zone.

15. The wake air injection apparatus according to claim 11, wherein the injector has at least one or more of a slot-shaped cross-section, an elliptical cross-section and a race track shaped cross-section.

16. The wake air injection apparatus according to claim 11, wherein the injector has a teardrop-shaped cross-section.

17. The wake air injection apparatus according to claim 11, wherein the injector comprises plural injectors.

18. The wake air injection apparatus according to claim 17, wherein one or more of the plural injectors has a unique shape.

19. The wake air injection apparatus according to claim 17, wherein one or more of the plural injectors has a unique penetration depth into the first space.

20. The wake air injection apparatus according to claim 11, wherein an angle of injection of the second fluid is between about 20-80°.

21. A combustor having wake air injection, comprising:

a fuel nozzle;

first and second vessels formed and disposed to define a flow path along which a first, low pressure fluid flows in first and second opposite directions toward the fuel nozzle;

a vane disposed in and transversely spanning the flow path; and an injector to inject a second, high pressure fluid into wake formed by an obstruction disposed in the flow path upstream from the vane.

22. The combustor according to claim 21, wherein the injector extends along at least one of radial and axial dimensions.

23. The combustor according to claim 21, wherein the injector has a slot-shaped cross-section.

24. The combustor according to claim 21, wherein the injector has an elliptical cross-section.

25. The combustor according to claim 21, wherein the injector has a race track-shaped cross-section.

26. The combustor according to claim 21, wherein the injector has a teardrop-shaped cross-section.

27. The combustor according to claim 21, wherein the injector comprises plural injectors.

28. The combustor according to claim 27, wherein one or more of the plural injectors has a unique shape and/or a unique penetration depth into the flow path.

29. The combustor according to claim 21, wherein an angle of injection of the second fluid into the wake is between about 20-80°.

30. A combustor having wake air injection, comprising:

a fuel nozzle configured to form a mixture of combustible materials to be supplied for combustion operations;

first and second vessels formed and disposed about the fuel nozzle to define a flow path along which a first, low pressure fluid flows in a first axial direction, then a radial direction and then a second axial direction, which is opposite the first axial direction, toward the fuel nozzle;

a vane disposed in and transversely spanning the flow path; and an injector to inject a second, high pressure fluid into wake formed by an obstruction disposed in the flow path at an axial location upstream from the vane.

* * * * *